US006052550A

United States Patent [19]

Thornton et al.

[11] Patent Number: 6,052,550

[45] Date of Patent: Apr. 18, 2000

[54] IMAGE SEPARATOR HAVING CONFORMABLE LAYER FOR CONTACT ELECTROSTATIC PRINTING

[75] Inventors: Constance J. Thornton, Ontario; Joseph Mammino; Robert M. Ferguson, both of Penfield; Edward L. Schlueter, Jr., Rochester, all of N.Y.

[73] Assignee: Xerox Corporation, Stamford, Conn.

[21] Appl. No.: 09/192,108

[22] Filed: Nov. 13, 1998

[51] Int. Cl.[7] ..... G03G 15/10

[52] U.S. Cl. ..... 399/237; 399/296

[58] Field of Search ..... 399/237–240, 399/308, 313, 296

[56] References Cited

U.S. PATENT DOCUMENTS

| | | | |
|---|---|---|---|
| 4,505,138 | 3/1985 | Kuehnle et al. . | |
| 5,337,129 | 8/1994 | Badesha | 399/308 |
| 5,340,679 | 8/1994 | Badesha et al. | 430/126 |
| 5,387,760 | 2/1995 | Miyazawa . | |
| 5,409,557 | 4/1995 | Mammino et al. | 430/126 X |
| 5,428,429 | 6/1995 | Fletcher | 399/308 |
| 5,436,706 | 7/1995 | Landa et al. . | |
| 5,585,905 | 12/1996 | Mammino et al. | 399/302 |
| 5,592,269 | 1/1997 | Younes et al. | 399/237 |
| 5,619,313 | 4/1997 | Domoto et al. | 399/233 |
| 5,802,442 | 9/1998 | Konno et al. | 399/308 |
| 5,826,147 | 10/1998 | Liu et al. | 399/296 X |
| 5,873,018 | 2/1999 | Aoto et al. | 399/302 |
| 5,937,248 | 8/1999 | Liu et al. | 399/237 |
| 5,991,582 | 11/1999 | Liu et al. | 399/237 |

*Primary Examiner*—William J. Royer

*Attorney, Agent, or Firm*—Annette L. Bade; Judith L. Byorick

[57] ABSTRACT

A contact electrostatic printing image separator having a substrate; and thereover a conformable layer with a conductive or semiconductive polymer; and an optional outer release layer positioned on the conformable layer, and contact electrostatic printing apparatuses including the image separator are included.

23 Claims, 5 Drawing Sheets

FIG. 3
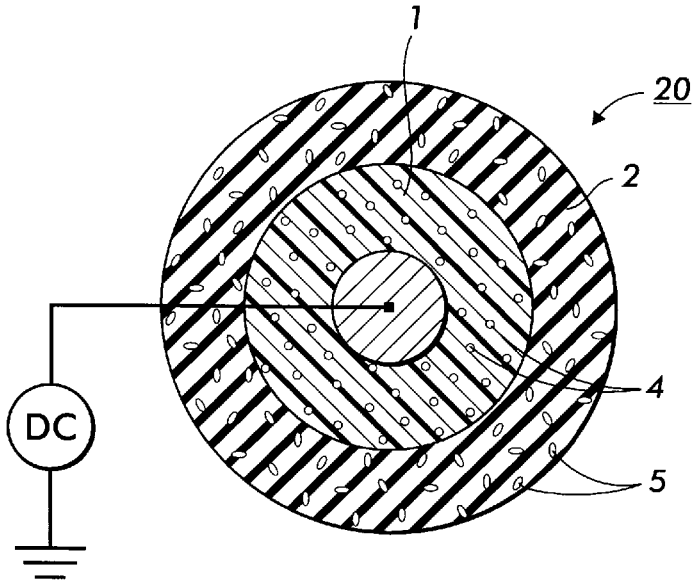
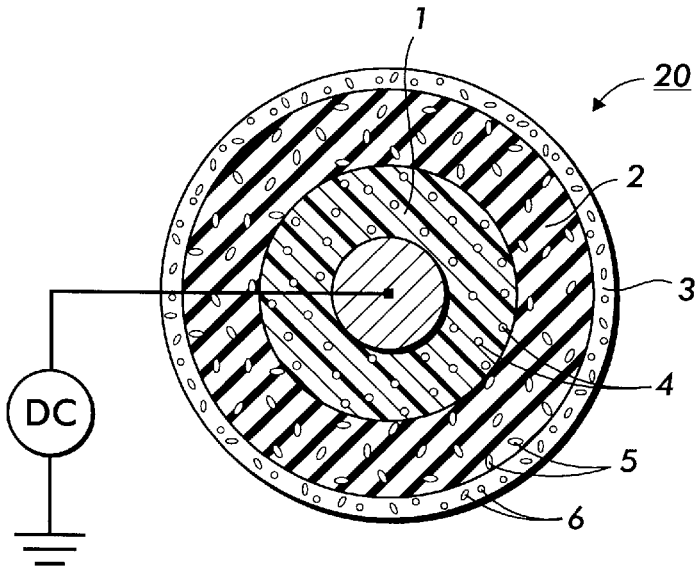
FIG. 4

IMAGE SEPARATOR HAVING CONFORMABLE LAYER FOR CONTACT ELECTROSTATIC PRINTING

FIELD OF THE INVENTION

This invention relates to image separators and their fabrication. These image separators are useful in an electrostatographic printing machine, especially a printing machine that employs a contact electrostatic printing process. The image separators herein comprise a substrate, a conformable layer, and an optional outer release layer. In optional embodiments, the conformable layer may comprise conductive particles dispersed or contained therein.

BACKGROUND OF THE INVENTION

Various methods of developing a latent image have been described in the art of electrophotographic printing and copying systems. Of particular interest with respect to the present invention is the concept of Contact Electrostatic Printing (CEP), which includes a variety of related liquid xerographic methods. In one process, an electrostatic image is produced on a image bearing member. The image bearing member is then coated with a uniform layer of liquid toner. Preferably, this layer of liquid toner is a thin and substantially uniform layer of high concentration liquid developing material. The toner layer is split image-wise between the image bearing member and an image separator, followed by transfer from the image separator to an image substrate such as paper. The development of the latent image occurs upon separation of the image bearing member and image separator surfaces. The development occurs as a function of the electric force strength generated by the latent image. In this process, toner particle migration or electrophoresis is replaced by direct surface-to-surface transfer of a toner layer. The particle migration is induced by image-wise forces. For the present description, the concept of latent image development via direct surface-to-surface transfer of a toner layer via image-wise forces will be identified generally as Contact Electrostatic Printing (CEP).

Generally, methods including CEP, are set forth in U.S. application Ser. No. 08/883,292 filed Jun. 27, 1997, entitled, "Electrostatic Latent Image Development;" U.S. application Ser. No. 08/884,236 filed Jun. 27, 1997, entitled "Image-wise Toner Layer Charging Via Air Breakdown For Image Development;" and U.S. application Ser. No. 09/004,629 filed Jan. 8, 1998, entitled "Image-wise Toner Layer Charging for Image Development." The disclosures of these references are hereby incorporated by reference in their entirety.

The image separator must have sufficient release properties to adequately release the developed image to a print substrate, such as paper. The image separator must also be conformable enough to transfer to rough print substrates. Additionally, since transfix is desirable in CEP, the image separator preferably is stable at temperatures of up to about 125° C.

SUMMARY OF THE INVENTION

The present invention is accomplished in embodiments by providing (a) an image bearing member comprising a developed image, wherein said developed image comprises a primary latent image and a secondary latent image; and (b) an image separator comprising said secondary latent image, wherein said image separator comprises: (i) a substrate; and thereover (ii) a conformable layer comprising a conductive or semiconductive polymer; and (iii) an optional outer release layer positioned on said conformable layer.

Embodiments of the invention also include (a) an image bearing member comprising a developed image, wherein said developed image comprises a primary latent image and a secondary image; and (b) an image separator comprising said secondary latent image, wherein said image separator comprises: (i) a substrate; and thereover (ii) a conformable layer comprising a polymer selected from the group consisting of silicone rubbers, fluoropolymers, polyurethanes and nitrile rubbers, and comprising a filler selected from the group consisting of metal oxides, carbon black, polymeric particles, and mixtures thereof; and (iii) an optional outer release layer positioned on said conformable layer.

BRIEF DESCRIPTION OF THE DRAWINGS

FIG. 3 is a cross sectional view of an embodiment of an image separator demonstrating a two layer configuration.

FIG. 4 is a cross sectional view of an embodiment of an image separator demonstrating a three layer configuration.

DETAILED DESCRIPTION OF THE INVENTION

The present invention is directed to image separators useful in an electrostatographic printing machine, especially a machine using contact electrostatic printing processes, wherein the image separator comprises a substrate, a conformable layer, and an optional outer release layer.

Figure 1:
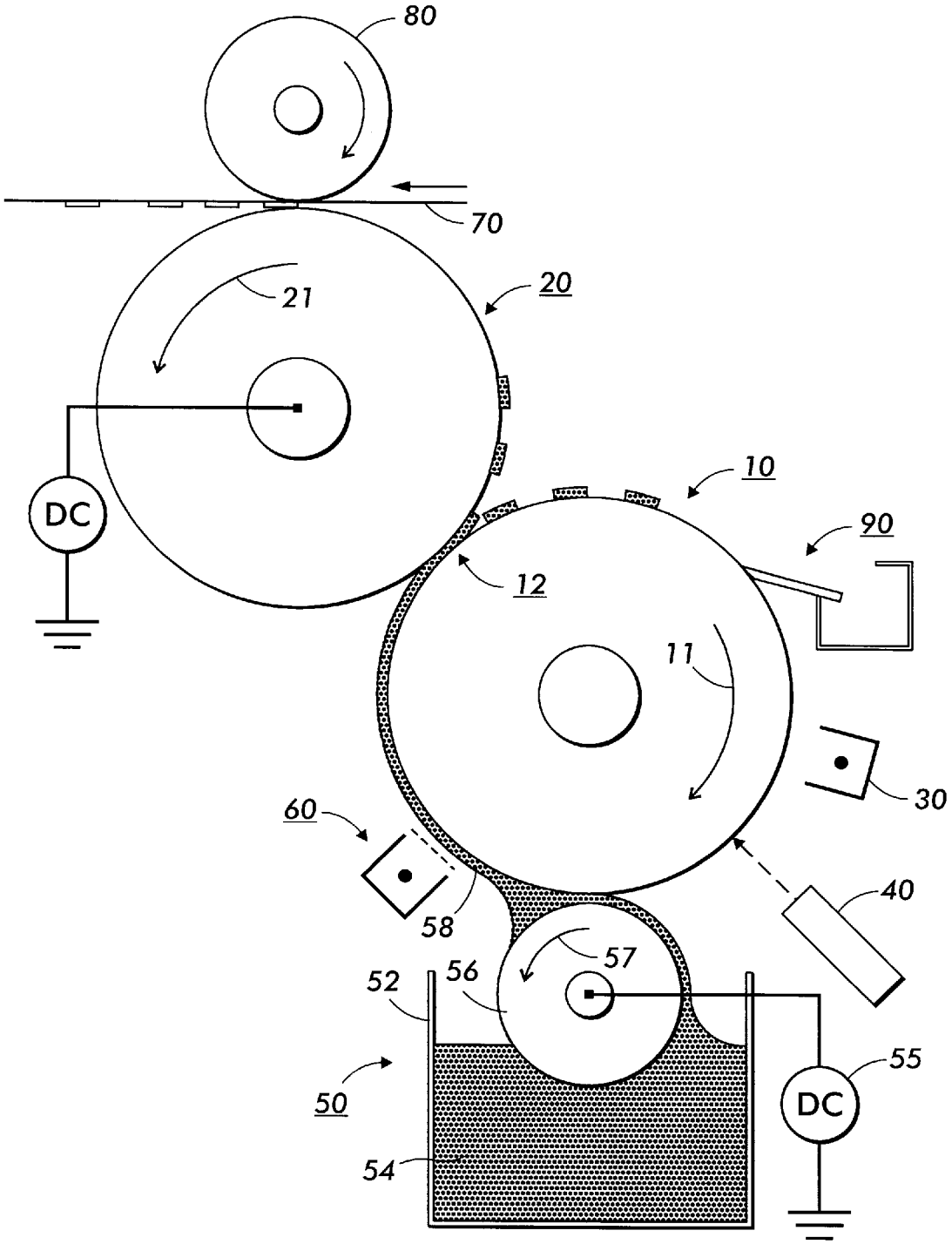
FIG. 1 is a schematic view of an embodiment of a contact electrostatic printing apparatus.

Reference is now made to the FIG. 1 which illustrates an imaging apparatus constructed and operative in accordance with one embodiment of the present invention. Shown in FIG. 1 is a first movable member in the form of a image bearing member 10 including an imaging surface of any type capable of having an electrostatic latent image formed thereon. Image bearing member 10 is rotated in the direction of arrow 11. In one embodiment, initially, the photoconductive surface of image bearing member 10 passes through a charging station 30, which may include a corona generating device or any other charging apparatus for applying a substantially uniform electrostatic charge to the surface of the image bearing member 10. Various charging devices, such as charge rollers, charge brushes and the like, as well as induction and semiconductive charge devices, may be used for charging member 30.

In the embodiment shown in FIG. 1, the charged surface is advanced to image exposure station 40. The image exposure station projects a light image corresponding to the input image onto the charged image bearing member surface. The light image projected onto the surface of the image bearing member 10 selectively dissipates the charge thereon for recording an electrostatic latent image on the image bearing member surface.

After the image bearing member is exposed, a toner supply apparatus 50 cake formation member applies a very thin layer of marking or toner particles (and possibly a carrier such as a liquid solvent) onto the surface of the image bearing member 10. FIG. 1 demonstrates an embodiment of a toner supply apparatus wherein housing 52 is adapted to accommodate a supply of toner particles 54 and any additional carrier material, if necessary. In this embodiment, the toner applicator 50 includes an applicator roller 56 which is rotated in direction 57 to transport toner from housing 52 into contact with the surface of the image bearing member 10. In this manner, a substantially uniformly distributed layer of toner 58, or a so-called "toner cake", is formed thereon.

The toner cake can be created in various ways, depending on the materials used in the printing process, as well as other process parameters such as process speed and the like. Generally, a layer of toner particles having sufficient thickness (preferably from about 2 to about 15 microns, and particularly preferably from about 3 to about 8 microns), may be formed on the surface of the imaging member 10 by transferring an ink cake of similar thickness and solid content from the applicator member 56. In a preferred embodiment, electrical biasing 55 may be employed to assist in actively moving the toner cake from the applicator 56 onto the surface of the image bearing member 10. In this embodiment, toner applicator 56 is provided with an electrical bias of magnitude greater than both the image and non-image (background) areas of the electrostatic latent image on the image bearing member 10. These electrical fields cause toner particles to be transferred to image bearing member 10 for forming a substantially uniform layer of toner particles on the surface thereof.

In the case of liquid developing materials, it is desirable that the toner cake formed on the surface of the image bearing member 10 be comprised of at least about 10 percent by weight toner solids, and preferably in the range of from about 15 to about 35 percent by weight toner solids.

After toner layer 58 is formed on the surface of the image bearing member 10, the toner layer is charged using charging device 60 (which, in embodiments, may be a scorotron device) in an image-wise manner. In embodiments, the charging device 60 introduces free mobile ions in the vicinity of the charged latent image to facilitate the formation of an image-wise ion stream extending from the source 60 to the latent image on the surface of the image bearing member 10. The ion source 60 should provide ions having a charge opposite the original toner layer charge polarity. To achieve good image quality, the charge member 60 is preferably provided with an energizing bias at its grid intermediate the potential of the image and non-image areas of the latent image on the image bearing member 10. The image-wise ion stream generates a secondary latent image in the toner layer made up of oppositely charged toner particles in image configuration corresponding to the original latent image.

Once the secondary latent image is formed in the toner layer, the image-wise charged toner layer is advanced to the image separator 20 which rotates in direction 21. The image separator 20 may be provided in the form of a biased roll member having a surface adjacent to the surface of the image bearing member 10, and preferably contacting the toner layer 58 residing on image bearing member 10. An electrical biasing source is coupled to the image separator 20. In embodiments as depicted in FIG. 1, the image separator 20 is biased with a polarity opposite the charge polarity of the image areas in the toner layer 58 for attracting image areas therefrom. The developed image is made up of selectively separated and transferred portions of the toner cake on the surface of the image separator 20. Background image byproduct is left on the surface of the image bearing member 10. Alternatively, the image separator 20 can be provided with an electrical bias having a polarity appropriate for attracting non-image areas away from the image bearing member 10. The toner portions corresponding to image areas on the surface of the imaging member can be maintained yielding a developed image thereon.

After the developed image is created, the developed image then may be transferred to a copy substrate 70 via image separator 20 together with a heated member 80 or a non-heated pressure member. The background image byproduct on either the image bearing member 10 is subsequently removed from the surface in order to clean the surface in preparation for a subsequent imaging cycle. FIG. 1 illustrates a blade cleaning apparatus 90. In the embodiment shown in FIG. 1, the removed toner is transported to a toner sump or other reclaim vessel so that the waste toner can be recycled and used again.

The process of generating a secondary latent image in the toner cake layer will be described in greater detail with respect to FIG. 2, where the initially charged toner cake 58 is illustrated, for purposes of simplicity only, as a uniformly distributed layer of negatively charged toner particles having the thickness of a single toner particle. The toner cake resides on the surface of the image bearing member 10 which is being transported from left to right past the broad source ion charging device 60. As previously described, the primary function of the broad source ion charging device 60 is to provide free mobile ions in the vicinity of the image beating member 10 having the toner layer and latent image thereon. As such, the broad source ion device may be embodied as various known devices, including, but not limited to, any of the variously known corona generating devices available in the art, as well as charging roll type devices, solid state charge devices and electron or ion sources analogous to the type commonly associated with ionographic writing processes.

Figure 2:
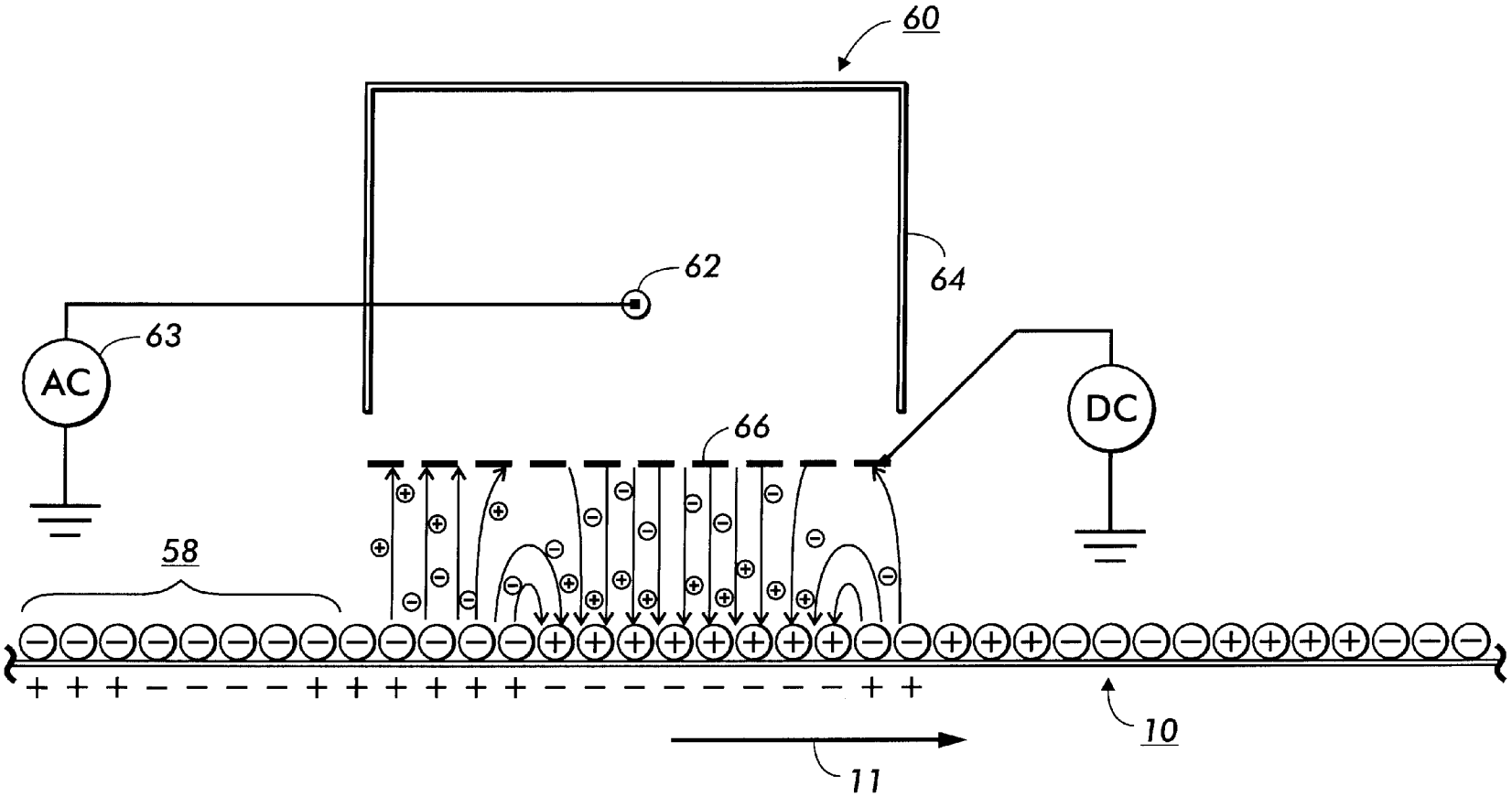
FIG. 2 is an exploded view illustrating image-wise charging of a toner layer by a broad source ion charging device, wherein a charged toner layer is selectively reverse charged in accordance with a latent image adjacent thereto, as contemplated by one embodiment of the present invention.

In the particular embodiment shown in FIG. 2, a scorotron type corona generating device is used. The scorotron device comprises a corona generating electrode 62 enclosed within a shield member 64 surrounding the electrode 62 on three sides. A wire grid 66 covers the open side of the shield member 64 facing the imaging member 10. In operation, the corona generating electrode 62, otherwise known as a coronode, is coupled to an electrical biasing source 63 capable of providing a relatively high voltage potential to the coronode, which causes electrostatic fields to develop between the coronode 62 and the grid and the image bearing member 10. The force of these fields causes the air immediately surrounding the coronode to become ionized, generating free mobile ions which are repelled from the coronode toward the grid 66 and the image bearing member 10. As is well known to one of skill in the art, the scorotron grid 66 is biased so as to be operative to control the amount of charge and the charge uniformity applied to the imaging surface 10 by controlling the flow of ions through the electrical field formed between the grid and the imaging surface.

In one embodiment, an ion source energized by an AC voltage having a DC grid 66 voltage intermediate to the image and non image areas of the latent image, represented by (+) and (−) signs, respectively, can be used to charge the back side of the imaging member 10. As illustrated, positive ions flow from the ion source 60 in the direction of the field lines while negative ions (electrons) flow in a direction opposite to the direction of the field lines such that the positive ions presented in the vicinity of a positively charged area of the latent image are repelled from the toner layer 58 while the positive ions in the vicinity of a negatively charged area of the latent image are attracted to the toner layer, and captured thereby. Conversely, negative ions presented in the vicinity of a positively charged area of the latent image are attracted to the image bearing member 10 and absorbed into the negatively charged toner 58 thereby enhancing toner charge in that area, while the negative ions in the vicinity of a negatively charged areas of the latent image are repelled by the toner layer. The free flowing ions generated by the ion source 60 are captured by toner layer 58 in a manner corresponding to the latent image on the imaging member, causing image-wise charging of the toner layer 58, thereby creating a secondary latent image within the toner layer 58 that is charged opposite in charge polarity to the charge of the original latent image. Under optimum conditions, the charge associated with the original latent image will be captured and converted into the secondary latent image in the toner layer 58 such that the original electrostatic latent image is substantially or completely dissipated into the toner layer 58. The subject matter of this embodiment is described in detail in U.S. application Ser. No. 08/883,292 filed Jun. 27, 1997, entitled, "Electrostatic Latent Image Development," the disclosure of which is hereby incorporated by reference in its entirety.

Figure 5:
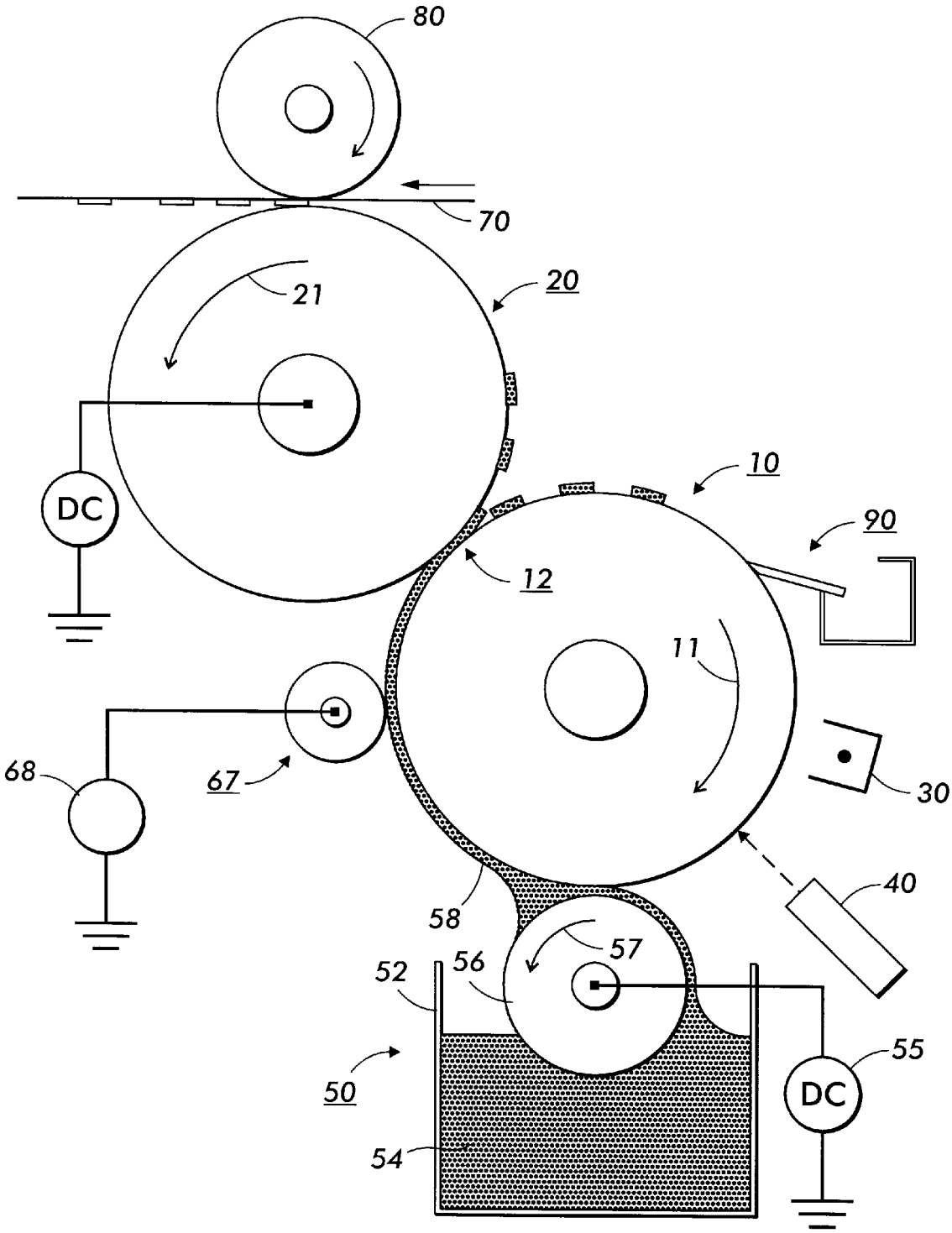
FIG. 5 is a schematic view of an alternative embodiment of a contact electrostatic printing apparatus, which comprises a bias roll member.
Figure 6:
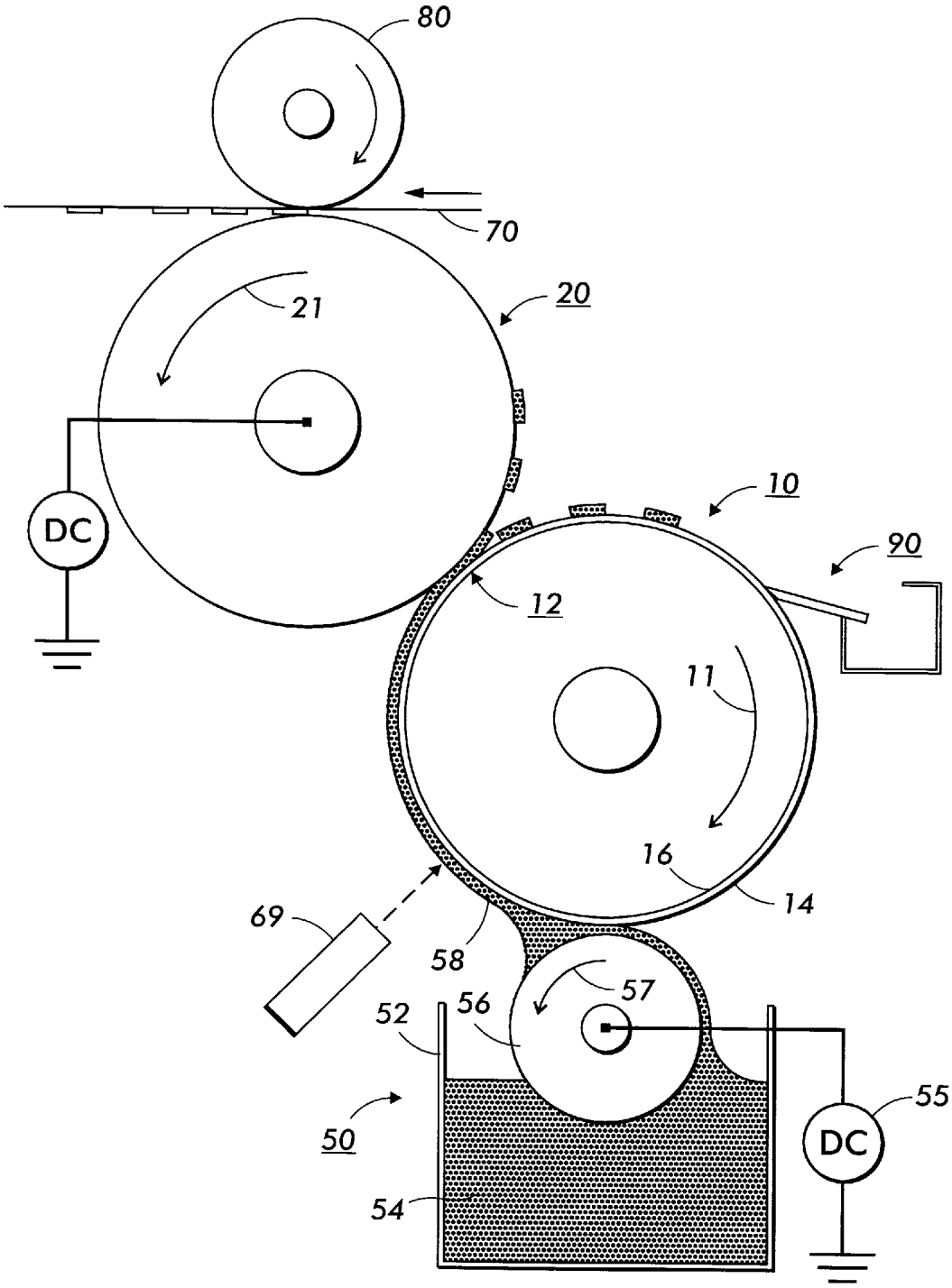
FIG. 6 is a schematic view of an alternative embodiment of a contact electrostatic printing apparatus, which comprises a charging device.

Alternative embodiments for charging the image bearing member and creating a secondary latent image may be employed. FIGS. 5 and 6 demonstrate two preferred alternative embodiments. It should be appreciated that the image separator of the present application can be used with other contact electrostatic printing apparatuses which employ toner cake as the developer material.

FIG. 5 demonstrates an alternative embodiment to forming a secondary latent image. The apparatus of FIG. 5 is the same as that depicted in FIG. 1, except that ion source 60 is replaced with biased roll member 67 and electrical biasing source 68. After the toner layer 58 is formed on the surface of the electrostatic latent image bearing imaging member 10, the toner layer is charged in an image-wise manner by inducing ionization of the air in the vicinity of the toner layer on the electrostatic latent image bearing imaging member 10. Thus, a biased roll member 67 is provided, situated adjacent the toner layer 58 on the imaging member 10, for introducing free mobile ions in the vicinity of the charged latent image to facilitate the formation of an image-wise ion stream extending from the roll member 67 to the latent image on the surface of the image bearing member 10. The image-wise ion stream generates a secondary latent image in the toner layer 58 made up of oppositely charged toner particles in image configuration corresponding to the original latent image generated on the imaging member 10. The primary function of the biased roll member 67 is to provide free mobile ions in the vicinity of the imaging member 10 having the toner layer 58 and latent image thereon. It is known that when two conductors are held near each other with a voltage applied between the two, electrical discharge will occur as the voltage is increased to the point of air breakdown. Thus, at a critical point, a discharge current is created in the air gap between the conductors. This point is commonly known as the Paschen threshold voltage. When the conductors are very close together (a few thousandths of an inch) discharge can take place without sparking, such that a discharge current will be caused to flow across a gap between the roll member 67 and the toner layer 58. The present invention uses the exploitation of this phenomenon to induce image-wise charging.

In operation, the biased roll member 67 is coupled to an electrical biasing source 68 capable of providing an appropriate voltage potential to the roll member, sufficient to produce air breakdown in the vicinity of a latent image bearing imaging member. Preferably, the voltage applied to the roll 67 is maintained at a predetermined potential such that electrical discharge is induced only in a limited region where the surface of the roll member 67 and the imaging member 10 are in very close-proximity, and the voltage differential between the roll and the image and/or non-image areas of the latent image exceeds the Paschen threshold voltage. In one preferred embodiment, which will be known as "one-way breakdown", it is contemplated that the bias applied to the roll 67 is sufficient to exceed the Paschen threshold voltage only with respect to either one of the image or non-image areas of the original latent image on the imaging member. Alternatively, in another embodiment, the bias applied to the roll 67 will be sufficient to exceed the Paschen threshold with respect to both the image or non-image areas of the original latent image. The air breakdown induced in this situation can be caused to occur in a manner such that field lines are generated in opposite directions with respect to the image and non-image areas. For example, in the case where the Paschen threshold voltage is about 400 volts, and the image and non-image areas have voltage potentials of about 0 and −1200 volts respectively, a bias potential applied to roll 67 of approximately −200 volts will result in air breakdown that generates charges only in the region of the non-image areas such that the toner particles adjacent to this region will be effected. Conversely, a bias of −1000 volts applied to roll 67, for example, will result in charge generation in the region of the image area of the latent image, with ions flowing in the opposite direction. In yet another alternative, a bias of approximately −600 volts applied to roll 67 will result in charge generation in the areas adjacent both image and non-image areas with ions flowing in opposite directions. This so-called two-way air breakdown mode occurs when an electrical discharge via air breakdown is induced in a pre-nip region immediately prior to a nip region created by contact between the imaging member 10 and the roll member 67. The electrical discharge causes electrostatic fields to develop between the roll member 67 and the imaging member 10 in the pre-nip region. In turn, the force of these fields causes the air to become ionized, generating free mobile ions which are directed toward the imaging member 10. The magnitude of the bias potential applied to the roll member 67 operates to control the image-wise ionization and the amount of charge and the charge uniformity applied to the imaging surface 10. Thus, in accordance with the example described above, two-way air breakdown can be induced by applying a bias voltage to roll 67 which is sufficient to exceed the Paschen threshold with respect to both image and non-image areas of a latent image on an imaging member brought into the vicinity of the roll 67. Providing that this bias applied to roll 67 in a range intermediate to the potential associated with the image and non-image areas, will result in proper control of the direction of charge flow for creating the desired latent image in the toner layer. The subject matter of this embodiment is described in detail in U.S. application Ser. No. 08/884,236 filed Jun. 27, 1997, entitled "Image-wise Toner Layer Charging Via Air Breakdown For Image Development," the disclosure of which is hereby incorporated in its entirety.

In another embodiment of the invention, the secondary latent image is formed in still yet another manner. The apparatus of FIG. 6 differs from that of FIGS. 1 and 5, in that there is absent a charging member 30 and an image exposure station 40. An exemplary toner layer support member 10 in this embodiment, may include a relatively thin surface layer 14 comprising a conductive material, an insulative material, a thin dielectric material of the type known to those of skill in the art of ionography, a semi-conductive material, or any other material which may be contemplated for use in a typical electrostatographic imaging system or otherwise. The surface layer 14 may be supported on an electrically conductive and preferably grounded support substrate 16. After the toner layer 58 is formed on the surface of the electrostatic latent image bearing imaging member 10, the toner layer is charged in an image-wise manner. In the case of a charged toner layer 58, as is the case in the system of FIG. 6, a charging device 69, represented schematically in FIG. 6 as a well known scorotron device, is provided for introducing free mobile ions in the vicinity of the charged latent image, to facilitate the formation of an image-wise ion stream extending from the source 69 to the latent image on the surface of the image bearing member 10, as will be described. The image-wise ion stream generates a secondary latent image in the toner layer made up of oppositely charged toner particles in image configuration corresponding to the latent image.

The toner cake resides on the surface of the imaging member 10 which is being transported from left to right past the broad source ion charging device 69. As previously described, the primary function of the broad source ion charging device 69 is to provide free mobile ions in the vicinity of the imaging member 10 having the toner layer and latent image thereon. As such, the broad source ion device may be embodied as various known devices, including, but not limited to, any of the variously known corona generating devices available in the art, as well as charging roll type devices, solid state charge devices and electron or ion sources analogous to the type commonly associated with ionographic writing processes. In the case of a charged toner layer, the process of the present invention requires that ion source 69 provide ions having a charge opposite the toner layer charge polarity. The disclosure of this embodiment is described in detail in U.S. application Ser. No. 09/004,629 filed Jan. 8, 1998, entitled "Image-wise Toner Layer Charging for Image Development," the disclosure of which is incorporated herein by reference in its entirety.

FIG. 3 demonstrates an embodiment of the image separator. The image separator 20 in FIG. 3 comprises substrate 1 and conformable layer 2. In addition, FIG. 3 demonstrates a preferred embodiment of the invention wherein substrate 1 comprises conductive filler 4, and wherein conformable layer 2 comprises conductive filler 5. Conductive fillers 4 and 5 may be the same or different.

FIG. 4 demonstrates another embodiment of the image separator, wherein image separator 20 comprises substrate 1, conformable layer 2 and outer release layer 3. Also depicted in FIG. 4 are conductive fillers in each layer, wherein substrate 1 comprises conductive filler 4, conformable layer 2 comprises conductive filler 5, and outer release layer 3 comprises conductive filler 6. Conductive fillers 4, 5, and 6 may be the same or different.

The conformable layer has a low modulus. Molding of the toner into the surface of the porous or rough paper (or other substrate) facilitates complete transfer. Transfer from non-conforming materials to rough substrates is limited to the contact points (high spots of the paper surface) and poor image quality results. The release layer provides surface qualities such that the toner image is moved through the process undisturbed but is easily transferred to paper. Toner sticks to poorly releasing materials resulting in degraded image quality and excessive need for cleaning the image separator. Therefore, a release layer facilitates toner transfer.

The image separator may be of various configurations. These configurations include a conformable layer positioned on a substrate, wherein the substrate may be a belt, sheet, film or roller. Also included as a suitable configuration is a conformable layer positioned on a substrate, and positioned on the conformable layer, an outer release layer. Again, the substrate may be in the form of a belt, sheet, film or roller. The conformable layer may comprise a conformable conductive material, a conformable semiconductive material, or a combination of both. The outer release layer is preferably a thin insulating release layer, but can be any other suitable layer. In another configuration, an insulating layer may be positioned on the conformable layer. In addition, there may be a suitable adhesive positioned between the conformable layer and the substrate, and/or positioned between the conformable layer and the outer release layer or thin insulating layer. In the belt or sheet or film substrate configuration, the belt may be a seamed or seamless.

In the configuration wherein the substrate is a belt, sheet, film or the like, preferred examples of suitable substrate materials include polyimides and polyamides such as PAI (polyamideimide), PI (polyimide), polyaramide, polyphthalamide, fluorinated polyimides, polyimidesulfone, polyimide ether, and the like. Specific examples are set forth in U.S. Pat. No. 5,037,587, the disclosure of which is herein incorporated by reference in its entirety. Other suitable materials for the substrate belt include polyester such as polyethylene naphthate; (PET) polyethylene terephthalate; polysulfone; polycarbonate; polyphenylene sulfide; polyketone; (PEEK) polyether ether ketone; (PES) polyethersulfone; PAEK (polyaryletherketone); PBA (potyparabanic acid); and the like. In another embodiment, the substrate may comprise a fabric material such as woven or nonwoven fabric, knitted or felted fabric, or any other suitable fabric using natural or synthetic fibers. Fabric, as used herein, refers to a textile structure comprised of mechanically interlocked fibers or filaments, which may be woven or nonwoven. Fabrics are materials made from fibers or threads and woven, knitted or pressed into a cloth or felt type structures. Woven, as used herein, refers to closely oriented by warp and filler strands at right angles to each other. Nonwoven, as used herein, refers to randomly integrated fibers or filaments. Examples of suitable fabrics include woven or nonwoven cotton fabric, graphite fabric, fiberglass, woven or nonwoven polyimide (for example KELVAR® available from DuPont), woven or nonwoven polyamide, such as nylon or polyphenylene isophthalamide (for example, NOMEX® of E.I. DuPont of Wilmington, Del.), polyester, polycarbonate, polyacryl, polystyrene, polyethylene, polypropylene, cellulosed, polysulfone, polyxylene, polyacetal, and the like. Details such fibers useful as substrates are set forth in U.S. patent application Ser. No. 09/050,135 filed Mar. 30, 1998, entitled "Fabric Fuser Film," the disclosure of which is hereby incorporated by reference in its entirety.

The polymer used as the substrate in the belt configuration may be filled or unfilled. Examples of preferred fillers include carbon black fillers, metal oxides, and polymer particles. Specific examples of fillers include carbon black, fluorinated carbon black, graphite, and the like, and mixtures thereof; metal oxides such as indium tin oxide, zinc oxide, iron oxide, aluminum oxide, copper oxide, lead oxide, and the like, and mixtures thereof; doped metal oxides such as antimony doped tin oxide, antimony doped titanium dioxide, aluminum doped zinc oxide, similar doped metal oxides, and mixtures thereof; and polymer particles such as polypyrrole, polyannaline, and the like, and mixtures thereof. Preferably, the filler, if present in the substrate, is present in an amount of from about 1 to about 40, and preferably from about 2 to about 30 percent by weight of total solids. Preferably, the belt substrate has a resistivity range of from about $10^3$ to about $10^{13}$ ohm-cm, and preferably from about $10^6$ to about $10^9$ ohm-cm.

It is preferable that the substrate be an endless, seamed flexible belt and seamed flexible belts, which may or may not include puzzle cut seams. Examples of such belts are described in U.S. Pat. Nos. 5,487,707; 5,514,436; and U.S. patent application Ser. No. 08/297,203 filed Aug. 29, 1994, the disclosures each of which are incorporated herein by reference in their entirety. A method for manufacturing reinforced seamless belts is set forth in U.S. Pat. No. 5,409,557, the disclosure of which is hereby incorporated by reference in its entirety.

In the configuration wherein the substrate is in the form of a roller, the substrate may comprise a tough, resistant plastic material such as any of the materials listed above for the belt configuration. Alternately, the roller may comprise a metal such as aluminum, nickel, stainless steel, or the like. In another embodiment, the roller may comprise a fabric as set forth above.

The conformable layer is preferably conformable enough to transfer the toner image to rough papers. Preferably, the conformable layer has a thickness of from about 0.001 to about 0.5 inches, and preferably from about 0.003 to 0.150 inches. Preferably, the conformable layer has a hardness of from about 30 to 70 Shore A units, preferably 50 to 60 Shore A units.

The conformable layer may comprise a conductive or semiconductive material. Examples of suitable conformable materials include fluoropolymers, including TEFLON® and TEFLON®-like materials and fluoroelastomers; silicone materials such silicone rubbers, siloxanes, polydimethylsiloxanes and fluorosilicones; aliphatic or aromatic hydrocarbons; polyurethanes; nitrile rubbers; copolymers or terpolymers of the above, and the like; and mixtures of these. The conductive or semiconductive material is present in an amount of about 30 to about 99.5, and preferably from about 60 to about 90 percent by weight of total solids.

Particularly useful fluoropolymer conformable layers for the present invention include TEFLON®-like materials such as polytetrafluoroethylene (PTFE), fluorinated ethylenepropylene copolymer (FEP), perfluorovinylalkylethertetrafluoroethylene copolymer (PFA TEFLON®), copolymers thereof, and the like.

Examples also include elastomers such as fluoroelastomers. Specifically, suitable fluoroelastomers are those described in detail in U.S. Pat. Nos. 5,166,031; 5,281,506; 5,366,772; 5,370,931; 4,257,699; 5,017,432; and 5,061,965, the disclosures each of which are incorporated by reference herein in their entirety. These fluoroelastomers, particularly from the class of copolymers, terpolymers, and tetrapolymers of vinylidenefluoride, hexafluoropropylene and tetrafluoroethylene and a possible cure site monomer, are known commercially under various designations as VITON A®, VITON E®, VITON E60C®, VITON E430®, VITON 910®, VITON GH® VITON GF®, VITON E45®, VITON A201C®, and VITON B50®. The VITON® designation is a Trademark of E.I. DuPont de Nemours, Inc. Other commercially available materials include FLUOREL 2170®, FLUOREL 2174®, FLUOREL 2176®, FLUOREL 2177®, FLUOREL 2123®, and FLUOREL LVS 76®, FLUOREL® being a Trademark of 3M Company. Additional commercially available materials include AFLAS™ a poly (propylene-tetrafluoroethylene) and FLUOREL II® (LII900) a poly(propylene-tetrafluoroethylenevinylidenefluoride) elastomer both also available from 3M Company. Also preferred are the TECNOFLONS® identified as FOR-60KIR®, FOR-LHF®, NM® FOR-THF®, FOR-TFS®, TH®, and TN505®, available from Montedison Specialty Chemical Company.

In a preferred embodiment, the fluoroelastomer is one having a relatively low quantity of vinylidenefluoride, such as in VITON GF®, available from E.I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer. The fluorine content of the VITON GF® is about 70 weight percent by total weight of fluoroelastomer.

Other suitable fluoroelastomers include the latex fluoroelastomers such as those available from Lauren International and Aussimont. Examples of latex fluoroelastomers are described in U.S. application Ser. No. 09/024,269, filed Feb. 17, 1998, entitled "Fluorinated Carbon Filled Latex Fluorocarbon Elastomer Surfaces and Methods Thereof," the disclosure of which is hereby incorporated by reference in its entirety. These materials have the advantage of being aqueous dispersions, and therefore, are environmentally friendly.

Other suitable fluoroelastomers include fluoroelastomer composite materials which are hybrid polymers comprising at least two distinguishing polymer systems, blocks or monomer segments, wherein one monomer segment (hereinafter referred to as a "first monomer segment") of which possesses a high wear resistance and high toughness, and the other monomer segment (hereinafter referred to as a "second monomer segment") of which possesses low surface energy. The composite materials described herein are hybrid or copolymer compositions comprising substantially uniform, integral, interpenetrating networks of a first monomer segment and a second monomer segment, and in some embodiments, optionally a third grafted segment, wherein both the structure and the composition of the segment networks are substantially uniform when viewed through different slices of the separator member layer. Interpenetrating network, in embodiments, refers to the addition polymerization matrix where the polymer strands of the first monomer segment and second monomer segment, and optional third grafted segment, are intertwined in one another. A copolymer composition, in embodiments, is comprised of a first monomer segment and second monomer segment, and an optional third grafted segment, wherein the monomer segments are randomly arranged into a long chain molecule.

Examples of polymers suitable for use as the first monomer segment or tough monomer segment include such as, for example polyamides, polyimides, polysulfones, and fluoroelastomers. Examples of the low surface energy monomer segments or second monomer segment polymers include polyorganosiloxanes, and include intermediates which form inorganic networks. An intermediate is a precursor to inorganic oxide networks present in polymers described herein. This precursor goes through hydrolysis and condensation followed by the addition reactions to form desired network configurations of, for example, networks of metal oxides such as titanium oxide, silicon oxide, zirconium oxide and the like; networks of metal halides; and networks of metal hydroxides. Examples of intermediates include metal alkoxides, metal halides, metal hydroxides, and a polyorganosiloxane as defined above. The preferred intermediates are alkoxides, and specifically preferred are tetraethoxy orthosilicate for silicon oxide network and titanium isobutoxide for titanium oxide network. In embodiments, a third low surface energy monomer segment is a grafted monomer segment and, in preferred embodiments, is a polyorganosiloxane as described above. In these preferred embodiments, it is particularly preferred that the second monomer segment is an intermediate to a network of metal oxide. Preferred intermediates include tetraethoxy orthosilicate for silicon oxide network and titanium isobutoxide for titanium oxide network.

Examples of suitable polymer composites include volume grafted elastomers, titamers, grafted titamers, ceramers, grafted ceramers, polyamide polyorganosiioxane copolymers, polyimide polyorganosiloxane copolymers, polyester polyorganosiloxane copolymers, polysulfone polyorganosiloxane copolymers, and the like. Titamers and grafted titamers are disclosed in U.S. Pat. No. 5,486,987; ceramers and grafted ceramers are disclosed in U.S. Pat. No. 5,337,129; and volume grafted fluoroelastomers are disclosed in U.S. Pat. No. 5,366,772. In addition, these fluoroelastomer composite materials are disclosed in U.S. Pat. No. 5,778,290. The disclosures of these patents are hereby incorporated by reference in their entirety.

Other elastomers suitable for use herein include silicone rubbers. Suitable silicone rubbers include room temperature vulcanization (RTV) silicone rubbers; high temperature vulcanization (HTV) silicone rubbers and low temperature vulcanization (LTV) silicone rubbers. Specific examples of suitable silicone rubbers include Rhodorsil® from Rhone Poulenc (with crosslinking agent Silbond® 40 (ethyle silicate), curing agent Fascat® 4200 (dibutyl tin diacetate)).

Other suitable conformable materials for the conformable layer include polyurethanes such as BAYHYDROL® 121 (Bayer), nitrile rubbers, and the like.

The conformable layer may be filled or unfilled with a suitable conductive filler. Preferred conductive fillers for addition to the conformable material include carbon black, metal oxides, and polymer particules. Preferably, the fillers include carbon black such as Black Pearls® 2000, fluorinated carbon such as those sold under the tradename ACCUFLUOR, graphite, and the like, and mixtures thereof; metal oxides such as indium tin oxide, zinc oxide, iron oxide, aluminum oxide, ferric oxide, ferrous oxide, copper oxide, lead oxide, and the like, and mixtures thereof; doped metal oxides such as antimony doped tin oxide, antimony doped titanium dioxide, aluminum doped zinc oxide, similar doped metal oxides, and mixtures thereof; and polymer particles such as polypyrrole, polyannaline, and the like, and mixtures thereof. The conductive filler, if present in the conformable layer, is preferably present in an amount of from about 2 to about 40 percenty, and preferably from about 5 to about 12 percent by weight of total solids. These ranges depend on the dispersion quality and the conductivity of the filler.

There may be present on the conformable layer, an outer release layer. The outer release layer may comprise a polymer such as a fluoropolymer or a silicone rubber. Examples of suitable fluoropolymers include TEFLON-like materials, fluoroelastomers such as those listed herein, other low surface energy polymers and elastomers. Preferred are TEFLON-like materials, and materials such as silicone which absorb some of the liquid toner carrier fluid and thus form a weak boundary. The outer release layer may or may not comprise fillers. If there is a filler present, the filler is present in the same amounts as set forth above for the conformable layer. Examples of suitable fillers include those listed above for the conformable layer. The outer release layer may comprise the same material as the conformable layer. The outer layer is thin, having a thickness of a monolayer or having a thickness of from about 0.01 to about 0.1 inches, preferably from about 0.02 to about 0.05 inches.

Suitable adhesives may be present between the substrate and the conformable layer, and between the conformable layer and the optional outer release layer. The choice of adhesive will depend on the composition of the layer or layers intended to be bonded.

A particularly preferred image separator comprises a polyimide substrate, an adhesive, and a silicone conformable layer with carbon black conductive filler and no outer release layer. Another preferred embodiment comprises a polyimide substrate, adhesive, a fluoroelastomer (such as VITON® GF) conformable layer with carbon black filler, adhesive, and an outer silicone outer release layer.

The image separator may be made by known processes including applying the conformable layer and/or release layers by spray coating, flow coating, slot draw down, and like known methods.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

Preparation of Conformable Image Bearing Member Layer

A conformable layer for an image bearing member used in a contact electrostatic apparatus, such as one of the apparatuses described herein, has been prepared as follows. A 3 mil thick conductive polyimide substrate was purchased from DuPont. An adhesive (Dow Corning A4040 primer) was spray coated onto the polyimide substrate. A conformable layer coating was prepared by mixing silicone rubber (Rhodorsil from Rhone Poulenc) in an amount of about 65 percent by weight of total solids with 9 percent by weight of total solids of ethyl silicate crosslinking agent (Silbond 40), and 6 percent by weight of total solids of carbon black (Black Pearls 2000). The carbon black was dispersed in the mixture by roll milling the mixture in a ceramic jar with 3,000 g of 0.5 inch ceramic shots for about 48 hours. The dispersion was filtered. Subsequently, about 0.20 percent by weight of total solids of dibutyl tin diacetate curing agent (Fascat 4200) was added by stirring. The solution was then applied to the polyimide substrate with adhesive thereon, by spray coating, slot draw down and flow coating processes. The coating was air dried for 15 minutes, and cured by step heat curing at temperatures ranging from about 90 to about 450° F. for about 12 hours. The resulting conformable coating was 0.003" thick.

The image bearing member just prepared was subjected to testing in a prototype contact electrostatic printing apparatus, and showed excellent sharp images with no background. Transfer efficiency was demonstrated at 100 percent, and the resulting copy quality was high with the desired high level of gloss. In addition, the configuration had the added benefit of adsorbing carrier flud from the LID image thus providing image conditioning. Flex life was found to be 300,000 cycles and breadboard cycling was in excess of 1,000 cycles.

We claim:

1. A contact electrostatic printing apparatus comprising:

(a) an image bearing member comprising a developed image, wherein said developed image comprises a primary latent image and a secondary latent image; and (b) an image separator comprising said secondary latent image, wherein said image separator comprises:

(i) a substrate; and thereover (ii) a conformable layer comprising a conductive or semiconductive polymer; and (iii) an optional outer release layer positioned on said conformable layer.

2. The image separator of claim 1, wherein the conformable layer comprises a polymer selected from the group consisting of fluoropolymers, polyurethanes and nitrile rubbers.

3. The image separator of claim 2, wherein said conformable layer comprises a fluoropolymer selected from the group consisting of (a) copolymers of vinylidene fluoride, hexafluoropropylene and tetrafluoroethylene, (b) terpolymers of vinylidene fluoride, hexafluoropropylene and tetrafluoroethylene, and (c) tetrapolymers of vinylidene fluoride, hexafluoropropylene, tetrafluoroethylene and a cure site monomer.

4. The image separator of claim 2, wherein said conformable layer comprises a fluoropolymer composite comprising a first monomer segment, a second monomer segment, and an optional third monomer segment, and wherein said composite is a substantially uniform, integral, interpenetrating network of said first monomer segment and said second monomer segment, and optionally said third monomer segment.

5. The image separator of claim 4, wherein said fluoropolymer composite is selected from the group consisting of a volume grafted haloelastomer, a titamer, a grafted titamer, a ceramer, a grafted ceramer, a polyimide polyorganosiloxane, and a polyester polyorganosiloxane.

6. The image separator of claim 1, wherein said conformable layer comprises silicone rubber.

7. The image separator of claim 1, wherein said conformable layer comprises a conductive filler.

8. The image separator of claim 7, wherein said filler is selected from the group consisting of carbon black, graphite, metal oxides, polymer particles, and mixtures thereof.

9. The image separator of claim 8, wherein said filler is a metal oxide selected from the group consisting of aluminum oxide, ferric oxide, ferrous oxide, indium tin oxide, zinc oxide, copper oxide, lead oxide, and mixtures thereof.

10. The image separator of claim 8, wherein said filler is a doped metal oxide selected from the group consisting of antimony doped tin oxide, antimony doped titanium dioxide and aluminum doped zinc oxide.

11. The image separator of claim 8, wherein said filler is selected from the group consisting of graphite, carbon black, fluorinated carbon black, and mixtures thereof.

12. The image separator of claim 1, wherein said substrate is in the form of a belt.

13. The image separator of claim 12, wherein said belt comprises a material selected from the group consisting of polyamide, polyester, polysulfone, polycarbonate, polyphenylene sulfide, polyether ether ketone, and mixtures thereof.

14. The image separator of claim 13, wherein said belt comprises polyimide.

15. The image separator of claim 1, wherein said substrate is in the form of a roller.

16. The image separator of claim 15, wherein said roller comprises a material selected from the group consisting of aluminum, nickel, stainless steel, and plastic.

17. The image separator of claim 1, wherein there is positioned on said conformable layer, an outer release layer.

18. The image separator of claim 17, wherein said release layer comprises a material selected from the group consisting of fluorpolymers and silicone rubbers.

19. The image separator of claim 17, wherein said release layer comprises a conductive filler selected from the group consisting of carbon black, metal oxides, polymer particles, and mixtures thereof.

20. The image separator of claim 1, wherein said image separator has a resistivity of from about of from about $10^3$ to about $10^{13}$ ohm-cm.

21. The image separator of claim 1, further comprising an electrical bias connected thereto.

22. The image separator of claim 1, wherein said conformable layer has thickness of from about 0.001 to about 0.5 inches.

23. A contact electrostatic printing apparatus comprising:

(a) an image bearing member comprising a developed image, wherein said developed image comprises a primary latent image and a secondary image; and (b) an image separator comprising said secondary latent image, wherein said image separator comprises:

(i) a substrate; and thereover (ii) a conformable layer comprising a polymer selected from the group consisting of silicone rubbers, fluoropolymers, polyurethanes and nitrile rubbers, and comprising a filler selected from the group consisting of metal oxides, carbon black, polymeric particles, and mixtures thereof and a secondary image; and (iii) an optional outer release layer positioned on said conformable layer.

* * * * *